US008616855B2

(12) United States Patent
Burchill et al.

(10) Patent No.: US 8,616,855 B2
(45) Date of Patent: Dec. 31, 2013

(54) INTEGRAL COMPRESSOR MOTOR AND REFRIGERANT/OIL HEATER APPARATUS AND METHOD

(75) Inventors: Jeffrey J. Burchill, Syracuse, NY (US); Yu H. Chen, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 680 days.

(21) Appl. No.: 12/811,843

(22) PCT Filed: Feb. 1, 2008

(86) PCT No.: PCT/US2008/001419

§ 371 (c)(1),
(2), (4) Date: Jul. 7, 2010

(87) PCT Pub. No.: WO2009/096923

PCT Pub. Date: Aug. 6, 2009

(65) Prior Publication Data

US 2010/0278660 A1 Nov. 4, 2010

(51) Int. Cl.

| | |
|---|---|
| ***F04B 49/06*** | (2006.01) |
| ***F04B 49/00*** | (2006.01) |
| ***H02P 7/00*** | (2006.01) |
| ***H02P 3/00*** | (2006.01) |

(52) U.S. Cl.
USPC ..... 417/45; 417/12; 318/436; 318/455

(58) Field of Classification Search
USPC ..... 417/12, 13, 228, 313, 902, 44.1, 45; 318/436, 453, 454, 355; 62/209
See application file for complete search history.

(56) References Cited

U.S. PATENT DOCUMENTS

| | | | | | |
|---|---|---|---|---|---|
| 2,412,981 | A | * | 12/1946 | Harrold | 62/209 |
| 3,133,429 | A | * | 5/1964 | Griffin | 417/313 |
| 3,208,237 | A | * | 9/1965 | Gerteis | 62/498 |
| 3,237,848 | A | * | 3/1966 | Pihl et al. | 417/228 |
| 4,066,869 | A | | 1/1978 | Apaloo et al. | |
| 4,638,643 | A | * | 1/1987 | Sakazume et al. | 62/209 |
| 4,755,657 | A | * | 7/1988 | Crim et al. | 219/536 |
| 4,912,938 | A | * | 4/1990 | Sulfstede et al. | 62/192 |
| 5,052,897 | A | * | 10/1991 | Yamashita et al. | 417/228 |

(Continued)

OTHER PUBLICATIONS

PCT International Preliminary Report on Patentability and Written Opinion of the International Searching Authority for International Patent Application No. PCT/US2008/001419, Aug. 12, 2010, 6 pages.

(Continued)

*Primary Examiner* — Peter J Bertheaud
(74) *Attorney, Agent, or Firm* — Cantor Colburn LLP

(57) ABSTRACT

A compressor apparatus includes a power source (26), a shell (12; 42), an electric motor (28; 52; 100; 200) having motor windings, and a control assembly (106; 206). The electric motor (28; 52; 100; 200) is located within the shell (12; 42). The control assembly a control assembly (106; 206) provides power to the motor windings from the power source (26) in two modes. A first mode provides power to the motor windings to generate heat without producing force output with the motor (28; 52; 100; 200). A second mode provides power to the motor windings to produce force output with the motor (28; 52; 100; 200). The control assembly (106; 206) activates the first mode for a selected time period prior to activation of the second mode in order to drive out a fluid (36) to reduce a risk of a flooded compressor start.

8 Claims, 4 Drawing Sheets

(56) References Cited

U.S. PATENT DOCUMENTS

| | | | | |
|---|---|---|---|---|
| 5,062,277 | A | 11/1991 | Heitmann et al. | |
| 5,252,036 | A * | 10/1993 | Bunch et al. | 417/313 |
| 6,886,354 | B2 * | 5/2005 | Dudley | 62/193 |
| 7,293,968 | B2 | 11/2007 | Hwang et al. | |
| 2004/0161345 | A1 | 8/2004 | Choi et al. | |
| 2006/0179855 | A1 | 8/2006 | Lifson et al. | |

OTHER PUBLICATIONS

International Search Report and Written Opinion for International Patent Application PCT/US2008/001419, mailed Sep. 30, 2008, 10 pages.

* cited by examiner

INTEGRAL COMPRESSOR MOTOR AND REFRIGERANT/OIL HEATER APPARATUS AND METHOD

BACKGROUND

The present invention relates to methods and apparatuses for heating electric motors and adjacent fluids.

Electric motors, such as electric compressor motors for refrigeration units, often operate over a range of ambient temperature conditions. During relatively low ambient temperature operation, compressors often cycle on and off due to limited load demand. During the compressor off time, temperatures of fluids associated with the refrigeration unit and compressor, such as oil and refrigerant, can be very low. Such low fluid temperatures can, for instance, affect oil delivery at compressor start up and reduce compressor reliability. In addition, if the refrigeration unit shuts down for an extended period of time, typically longer than about six hours, the liquid refrigerant starts to migrate to the compressor, which is generally the most massive component in the system. The presence of refrigerant in the compressor at start-up produces what is known as a "flooded start". When the compressor starts in a flooded condition, the liquid refrigerant in the compressor causes high stress for the compressor and other components in the system and therefore reduces reliability.

It is thus desirable to heat refrigerant and oil under low ambient temperature conditions to facilitate reliable operation of a compressor. One existing solution is to use an external electrical crankcase heater to heat the refrigerant and oil by heat transfer through the compressor base and shell (see, e.g., U.S. Pat. Nos. 3,133,429; 4,066,869; 4,755,657; and 5,062,277). However, this known solution presents a number of problems. An external element increases the number of components in the refrigeration unit. These external heaters also require proper installation using a heat sinking compound. During use, the external heater must resist moisture and corrosion during thermal cycling, which can make construction and maintenance problematic. Also, these external heaters can result in inefficient transfer of heat to refrigerant and oil in a compressor.

SUMMARY

Exemplary embodiments of the invention include a compressor apparatus that includes a power source, a shell, an electric motor having motor windings, and a control assembly. The electric motor is located within the shell. The control assembly a control assembly provides power to the motor windings from the power source in two modes. A first mode provides power to the motor windings to generate heat without producing force output with the motor. A second mode provides power to the motor windings to produce force output with the motor. The control assembly activates the first mode for a selected time period prior to activation of the second mode in order to drive out a fluid to reduce a risk of a flooded compressor start.

A method of operating an electric motor having motor windings includes obtaining power from a power source, providing power to the motor windings for a selected period of time to generate heat without producing force output, and subsequently providing AC power to the motor windings to generate force output.

DETAILED DESCRIPTION

In general, an exemplary embodiment of the invention includes connecting a motor (e.g., a compressor motor), such as an electric motor, to a constant current power source, either DC or AC, which can heat up the motor's windings without producing a force output. This enables the motor to serve the function of a heater during motor off time, that is, when then motor is not providing a force output (i.e., performing mechanical work). Heat produced by the motor can be used to increase lubricant viscosity, for example. Furthermore, the motor can be controlled so as to reduce flooded starts, which can otherwise provide reliability problems for compressor motors with fluids that can migrate to the compressor, by generating heat with the motor for a selected time period before starting the motor to produce force output. Although the present invention provides many useful benefits for application to compressor motors, the invention is useful for other types of systems with motors as well.

Figure 1:
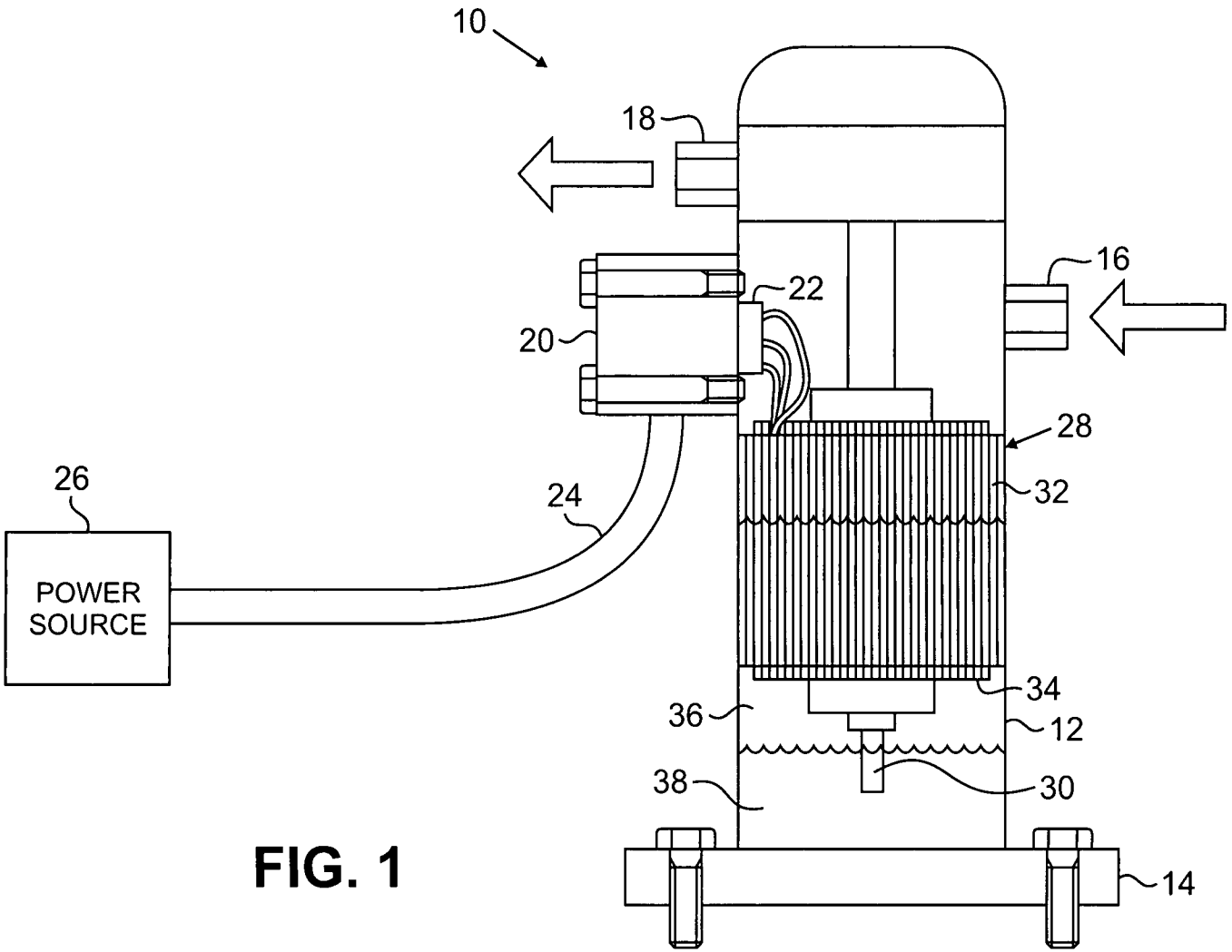
FIG. 1 is a cross-sectional view of a scroll-type compressor.
Figure 2:
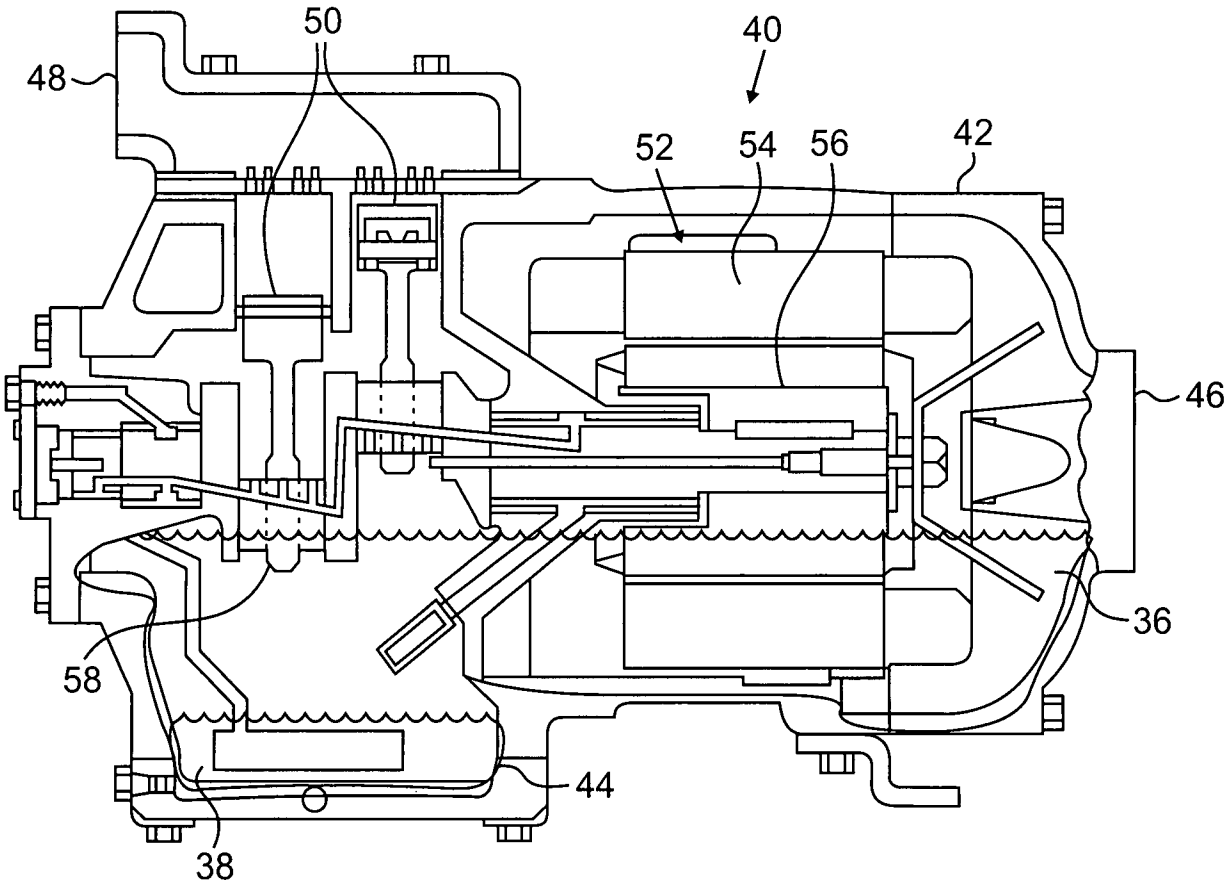
FIG. 2 is a cross-sectional view of a reciprocating-type compressor.

FIGS. 1 and 2 show two types of compressors suitable for use with refrigeration systems, among other applications. FIG. 1 is a cross-sectional view of an exemplary scroll compressor, and FIG. 2 is a cross-sectional view of an exemplary reciprocating-type compressor. These compressors are described merely by way of example and not limitation, and it should be recognized that the present invention applies to any hermetic and semi-hermetic compressors.

Turning first to FIG. 1, a scroll-type compressor 10 is shown that includes a shell 12 with a connection base 14, a suction port 16, a discharge port 18, a power wiring terminal block housing 20 with a sealed feedthrough 22 (e.g., a Fusite® glass-to-metal hermetically sealed feedthrough, available from Fusite USA, Cincinnati, Ohio, USA), power input cable 24 connected to a power source 26, and an electric motor assembly 28. The electric motor assembly 28 includes a drive shaft 30, a stator 32 and a rotor 34. Also shown in FIG. 1 inside the shell 12 of the compressor 10 are a refrigerant fluid 36 and oil 38. The compressor 10 can include additional component not specifically described, for instance, the ports 16 and 18 are connected to suitable tubing as part of a refrigerant system (not shown). Moreover, the particular configuration of the compressor 10 can vary as desired for particular applications.

In operation, the electric motor assembly 28 can be powered to provide a force output that can draw the refrigerant fluid 36 in through the suction port 16 and push the refrigerant fluid 36 out through the discharge port 18 while increasing fluid pressure. When the compressor 10 is "off", that is, when the electric motor assembly 28 is not providing a force output to move the refrigerant fluid 36, the refrigerant fluid 36 in liquid form can migrate and accumulate in the shell 12 of the compressor 10 as shown in FIG. 1. Furthermore, the oil 38 is used to lubricate components of the compressor 10, and when the electric motor assembly 28 is "off" (i.e., not providing a force output to move the refrigerant fluid 36), the oil 38 can collect in one location, such as through the influence of gravity. The oil 38 and the refrigerant fluid 26 will generally not mix, with the oil 38 being heavier and sinking below the refrigerant fluid 36 in liquid form. The general operation of rotary compressors is well known in the art, and therefore detailed discussion here is unnecessary.

With respect to FIG. 2, a reciprocating-type compressor 40 is shown that includes a shell 42 defining an oil sump 44, a suction port 46, a discharge port 48, pistons 50, and an electric motor assembly 52. The electric motor assembly 52 includes a stator 54, a rotor 56, and a crankshaft 58. As shown in FIG. 2, refrigerant fluid 36 in liquid form and oil 38 are present in the shell 42, with the oil 38 collected in the oil sump 44. The electric motor assembly 52 can operate in a conventional manner, with the electric motor assembly 52 capable of turning the crankshaft 58 to move the pistons 50 in order to pull the refrigerant fluid 36 in through the suction port 46 and push the refrigerant fluid 36 out through the discharge port 48 while increasing fluid pressure. The general operation of reciprocating compressors is well known in the art, and therefore detailed discussion here is unnecessary.

Electric motors, such as those for the compressors 10 and 40, often operate over a range of ambient temperature conditions. One problem that can develop under relatively low ambient temperature conditions is that lubricant viscosity increases, reducing delivery and effectiveness of the oil 38, leading to reliability problems. Another problem under relatively low ambient temperature conditions is what is known as a "flooded start". Take for instance a refrigeration unit with a compressor like the compressor 10 or 40. If the refrigeration unit shuts down for an extended period of time, typically longer than about 6 hours, the refrigerant fluid 36 (in liquid form) starts to migrate to the compressor 10 or 40, which is typically the most massive component in the system. When the electric motor of the compressor 10 or 40 starts, the liquid refrigerant fluid 36 present in the compressor 10 or 40 can cause high stress for system components, undesirably reducing reliability. In order to mitigate problems associated with relatively low ambient temperature operation, it is desirable to provide means to generate heat for the compressor 10 or 40.

Figure 3:
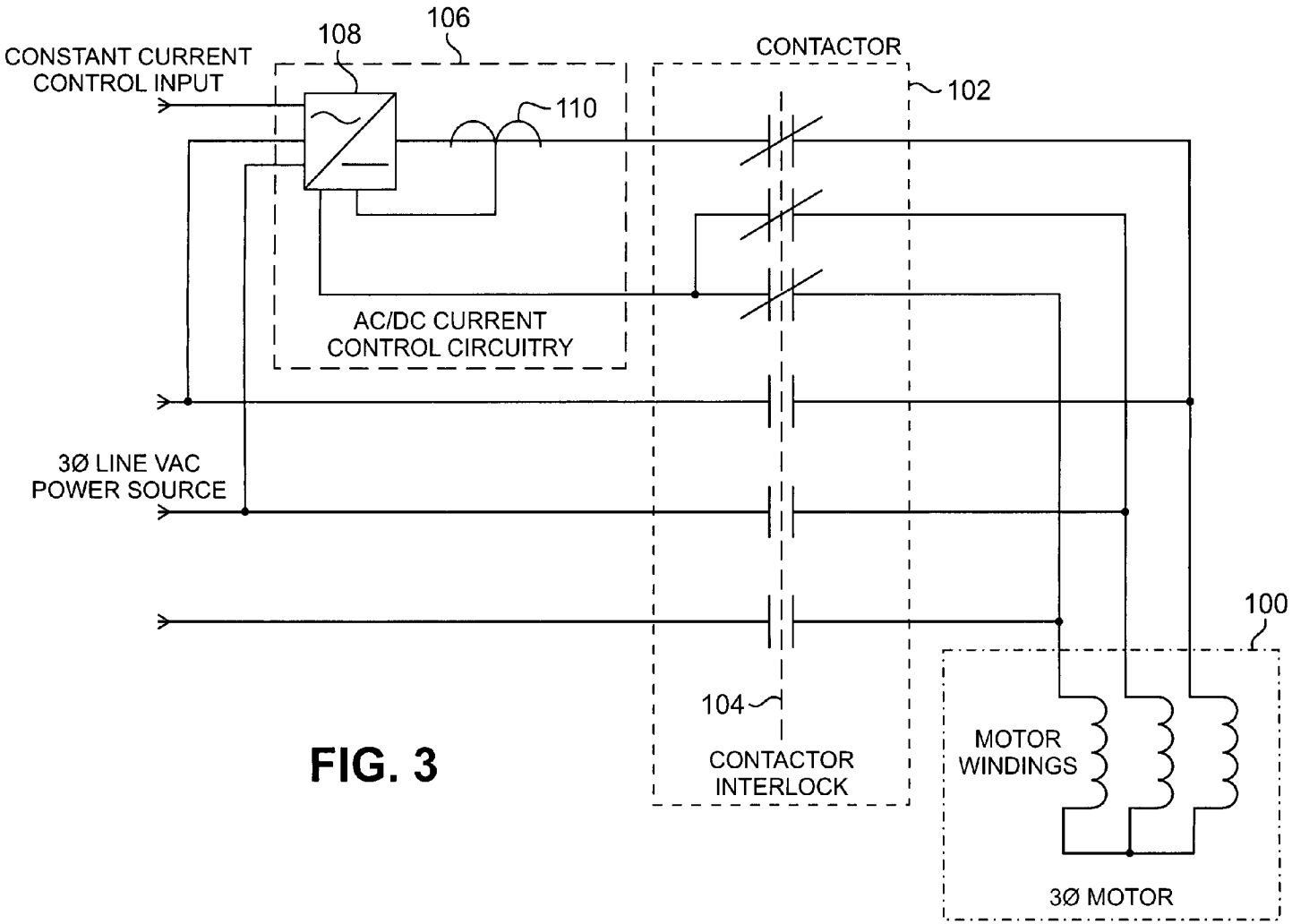
FIG. 3 is a schematic representation of a portion of motor control circuitry for a three-phase induction motor.

FIG. 3 is a schematic representation of a portion of motor control circuitry for an electric three-phase (3Ø) induction motor 100, which can be utilized with compressors such as the compressors 10 and 40 described above. The circuitry includes a contactor 102, a contactor interlock 104, and AC/DC current control circuitry 106 with current source 108 and current sensing 110 components.

The circuitry is configured such that the motor 100 can provide either heater operation or provide force output, in a mutually exclusive manner regulated by the contactor 104 and contactor interlock 104. When the motor 100 is "on" (i.e., producing a force output), the heater functionality is off due to actuation of the interlock 104. When the motor 100 is "off" (i.e., not producing a force output), the heater functionality is controlled through the current source 108 that can turn on and off and vary a level of current going through the motor windings of the motor 100. As shown in FIG. 3, the contactor interlock 104 is actuated to provide heater functionality. The current supplied to the motor windings of the motor 100 is controlled by the constant current source 108 that provides the selected amount of current to accomplish these two functions. A single power source (e.g., AC power from a grid) can be used by the circuitry in FIG. 3 to supply both the heater operation and force output operation of the motor 100.

In order to use motor windings of the motor 100 for heater operation rather than to produce a force output, DC or significantly reduced AC power is utilized. For an embodiment using DC power supplied to the motor windings of the motor 100, the current source 108 acts as an AD/DC converter capable of producing a DC current. A control input signal is provided to the current source 108 that would allow variation of current level during the compressor "off" time. In this way, desired DC current can be generated through the current source 108 by pulse width modulation (PWM) from power source voltage. PWM control logic can also be used to vary the current level, and thereby controllably vary an amount of heat generated by motor windings of the motor 100 according to the control input signal as a function of ambient temperature and other system conditions as desired to optimize factors such as power usage and heat output. Furthermore, the current sense component 110 can be used to sense current so that voltage can be controlled and PWM control can provide a feedback loop for heater operation of the motor 100. For an embodiment using significantly reduced AC power supplied to the motor windings of the motor 100, the current source 108 provides AC power to the motor 100 at a level too low to rotate a rotor of the motor 100 or otherwise generate a force output. The level of AC power can be varied to control the amount of heat generated by the motor 100.

The motor windings of the motor 100 have electrical resistance and produce heat when current flows through them for heater operation. The amount of heat produced is proportional to the resistance and the square of the current. According to the present invention, the current supplied to the motor windings of the motor 100 to provide heater operation can be controlled to (a) provide the correct amount of heat to raise oil and refrigerant temperature to a suitable level to ensure desired compressor reliability, and (b) not exceed a temperature insulation rating of the motor windings (magnet wire).

Where the motor 100 is used as a compressor, the motor windings of the motor 100 are integral with the compressor and are contained in the compressor shell where the windings can be in contact with the system refrigerant and/or lubricant, as shown in FIGS. 1 and 2. If the refrigerant and/or oil level is below the windings, heat can be transferred from the windings to the refrigerant and/or lubricant via the compressor shell, the drive shaft/crankshaft, and other components.

When current flows through the motor windings, heat is produced to raise an internal temperature of the compressor. The amount of current supplied to motor windings of the motor 100 during heater operation is determined as a function of resistance of the motor windings, amount of heat needed, and a maximum temperature rating of the motor windings magnet wire. The motor winding resistance and motor winding magnet wire temperature rating are factors determined by design specifications of the motor 100 used in a particular application. It should be noted that conventional electric motors typically include an internal protector (not shown), such that if the motor windings get too hot the circuitry is opened to avoid damaging the windings. For example, in one embodiment, motor windings can have total combined resistance of about 1.6 ohms. If PWM is used to generate constant DC current of 10 Amps through the motor windings, this exemplary embodiment will provide 160 watts of heat, which will typically provide a maxiumum temperature rise much lower than the winding maximum insulation temperature rating.

The amount of heat produced during heater operation of the motor 100 is selected as a function of desired heating objectives and system specifications. For instance, the amount of heat produced can be selected in part by a determination of the amount of heat needed to bring oil or other lubricants to a suitable viscosity to allow easy flow. This amount of heat needed can be derived in a conventional manner by sensing ambient temperature and taking into consideration specific heat capacities of the oil or other lubricants.

Moreover, the amount of heat produced can be selected in part by a determination of the amount of heat needed to eliminate (e.g., evaporate) liquid refrigerant from a compressor to prevent flooded starts. In order to reduce flooded starts for electric compressor motors, control logic can be implemented to operate the electric motor as a heater (without producing a force output) for a selected period of time, for example about 10 to 30 minutes, to heat up the liquid refrigerant and drive it out of the compressor before starting the compressor, such as by evaporating all liquid refrigerant present within the compressor shell.

Figure 4:
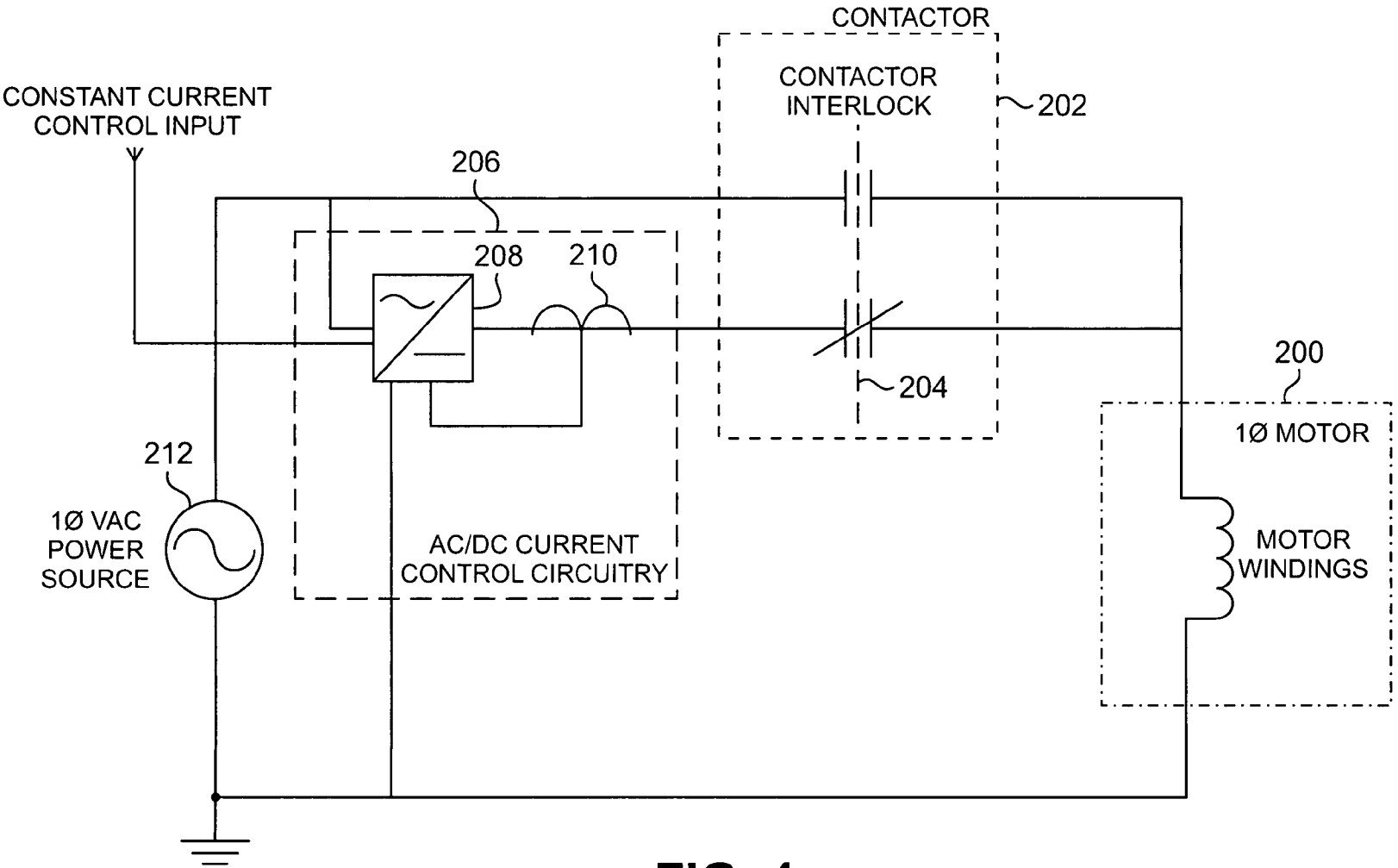
FIG. 4 is a schematic representation of a portion of motor control circuitry for a single-phase induction motor.

It should be recognized that the present invention is applicable to a variety of types of electric motors. FIG. 4 is a schematic representation of a portion of motor control circuitry for a single-phase (1Ø) induction motor 200. The circuitry includes a contactor 202, a contactor interlock 204, AC/DC current control circuitry 206 with current source 208 and current sensing 210 circuitry, and 1Ø vac power source 212. As shown in FIG. 4, the contactor interlock 204 is actuated to provide heater functionality. The operation of the motor 200 is similar to that described above with respect to the motor 100, in that the motor can be switched between force output operation and heater operation. Heater operation can be controlled numerous ways similar to those described above with respect to the motor 100 in order to generate desired amounts of heat under suitable limits.

It should be recognized that the present invention provides numerous advantages and benefits. Comparing the apparatus of the present invention to a traditionally used crankcase heater which often located outside of the compressor, the apparatus of the present invention can provide a direct heat source to efficiently heat up the refrigerant and oil. In an exemplary embodiment such as a compressor that is used in a container refrigeration unit, in which there can be corrosion and moisture, using a compressor motor as an integral heater according to the present invention reduces or eliminates issues related with moisture and corrosion commonly associated with separated, external crankcase heaters. Additionally, the use of a motor located inside a compressor shell can provide heat more directly and efficiently to fluids than external heaters. Furthermore, the use of control logic to provide heat prior to compressor startup can reduce a risk of a flooded start, to increase reliability.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For instance, the present invention can be applied to near any type of hermetic or semi-hermetic positive displacement compressor, such as scroll, screw, vane, reciprocating compressors (e.g., single-acting, double-acting, and other types), etc. Moreover, the present invention can be used to generate heat with electric motors for a variety of applications, such as to heat bearing lubricants of electric fans.

What is claimed is:

1. A compressor apparatus comprising:

a power source;

a shell;

an electric motor having motor windings, wherein the electric motor is located within the shell; and a control assembly for providing power to the motor windings from the power source in two modes, wherein a first mode provides power to the motor windings to generate heat without producing force output with the motor, wherein a second mode provides power to the motor windings to produce force output with the motor, wherein the control assembly activates the first mode for a selected time period prior to activation of the second mode in order to drive out a fluid to reduce a risk of a flooded compressor start; and wherein the control assembly comprises a current sensing circuit for measuring current flowing between the power source and the motor windings, wherein in the first mode the control assembly provides power to the motor windings to generate heat for the selected time period as a function of feedback from the current sensing circuit.

2. The apparatus of claim 1, wherein the control assembly provides AC power to the motor windings from the power source in the second mode, and wherein the control assembly provides pulse width modulated DC power to the motor windings from the power source in the first mode.

3. The apparatus of claim 1, wherein the control assembly provides AC power to the motor windings from the power source in the second mode, and wherein the control assembly provides AC power to the motor windings from the power source in the first mode at a lower voltage than in the second mode.

4. The apparatus of claim 1, wherein the electric motor comprises a three phase induction motor.

5. The apparatus of claim 1, wherein the electric motor comprises a single phase induction motor.

6. The apparatus of claim 1 and further comprising:

a contactor interlock for switching between the second mode that powers the motor windings to produce force output with the motor and the first mode that powers the motor windings to generate heat without producing force output with the motor, the contactor interlock switching between the first mode and the second mode in a mutually exclusive manner.

7. The apparatus of claim 1, wherein the compressor apparatus is of a type selected from the group consisting of hermetic and semi-hermetic compressors.

8. The apparatus of claim 1, further comprising: a contactor interlock including a first set of terminals to provide the power to the motor windings to generate heat without producing force output with the motor and a second set of terminals to provide the power to the motor windings to produce force output with the motor, the contactor interlock switching between the first set of terminals and the second set of terminals in a mutually exclusive manner.

* * * * *